US005832573A

United States Patent [19]

Howell

[11] Patent Number: 5,832,573

[45] Date of Patent: Nov. 10, 1998

[54] QUICK RELEASE BUCKLE ASSEMBLY

[75] Inventor: Clarence F. Howell, Bridgton, Me.

[73] Assignee: Down East, Inc., Bridgton, Me.

[21] Appl. No.: 919,490

[22] Filed: Aug. 28, 1997

Related U.S. Application Data

[63] Continuation-in-part of Ser. No. 748,817, Nov. 14, 1996.

[51] Int. Cl.[6] ..... A44B 17/00

[52] U.S. Cl. ..... 24/664; 24/616; 24/647

[58] Field of Search ..... 24/664, 647, 616, 24/615, 614, 662, 683, 651, 265 CD, 68 CD, 585, 170, 3.13, 633, 634

[56] References Cited

U.S. PATENT DOCUMENTS

| | | | |
|---|---|---|---|
| 2,908,057 | 10/1959 | Blanco | 24/3.13 |
| 2,933,795 | 4/1960 | Meeker | 24/647 |
| 3,212,152 | 10/1965 | Tanaka et al. | 24/647 |
| 4,458,392 | 7/1984 | Pogharian et al. | 24/664 |
| 4,924,562 | 5/1990 | Pogharian | 24/647 |
| 5,279,021 | 1/1994 | Edgin | 24/647 |
| 5,435,047 | 7/1995 | Colpo | 24/616 |

*Primary Examiner*—Victor N. Sakran

*Attorney, Agent, or Firm*—Samuels, Gauthier, Stevens & Reppert

[57] ABSTRACT

A quick release buckle assembly which is activated by pulling upwardly on a short lanyard. The buckle comprises a keeper part including a latch and a secure part. The secure part has a leading edge which is chamfered in several planes to facilitate its insertion into the keeper part. The latch per se flexes to facilitate locking and unlocking the keeper part and the secure part.

4 Claims, 4 Drawing Sheets

QUICK RELEASE BUCKLE ASSEMBLY

CROSS-REFERENCE TO RELATED APPLICATION(S)

This application is a continuation-in-part application of U.S. patent application Ser. No. 08/748,817 filed Nov. 14, 1996.

BACKGROUND OF THE INVENTION

Load bearing webbing is used by military personnel, hunters, sportsman, i.e. campers and mountain climbers. There are many situations where it is desirable to quickly and reliably detach load carrying packs and slings from the users. Usually in these environments a button and snap device is used which allows the users, such as soldiers, to pull upwardly on a short lanyard to detach the load bearing webbing.

Although the lanyard release action is favored by the users, the mechanical characteristics of the button and snap device are not. Prior art devices are prone to foul and do not release at critical moments in the field and do not release well if not under a load. Also, the buckle is difficult to re-attach in the dark with or without removing gloves.

It is believed U.S. Pat. Nos. 4,924,562 and 4,458,392 represent the most relevant prior art.

SUMMARY OF THE INVENTION

The present invention is directed to a quick release buckle assembly which is activated by pulling upwardly on a short lanyard. The mechanism does not rely upon springs, buttons, snaps, bails or webbing which are prone to foul when used in the field.

With the buckle of the invention, a positive mechanically reliable release action is used to force the buckle apart. The release functions equally well whether or not the attached webbing is under load and even if both parts of the buckle assembly are partially restrained. The buckle assembly of the invention is easy to orient. The two parts can be mated without the benefit of sight and while wearing heavy gloves. The buckle comprises a keeper part including a latch and a secure part. The secure part has a leading edge which is chamfered in several planes to facilitate its insertion in the keeper part. The latch per se flexes to facilitate locking and unlocking the keeper part and the secure part.

DESCRIPTION OF THE PREFERRED EMBODIMENT(S)

Figure 1:
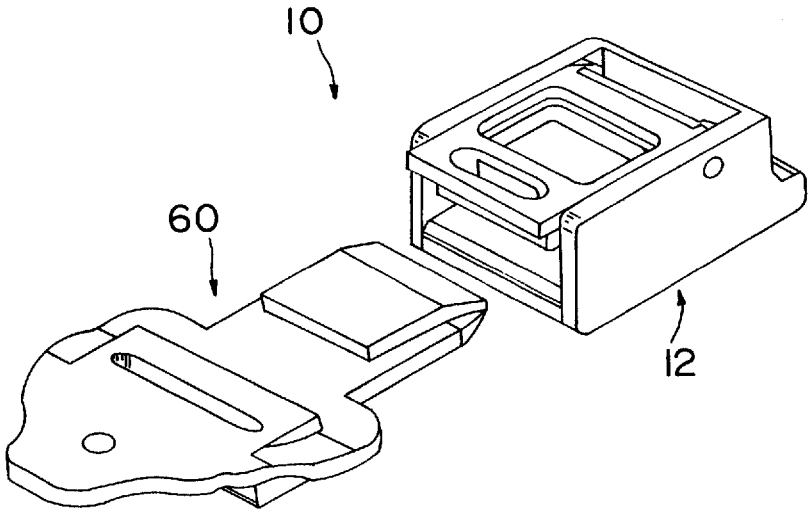
FIG. 1 is an exploded perspective view of a buckle assembly embodying the invention.
Figure 2A:
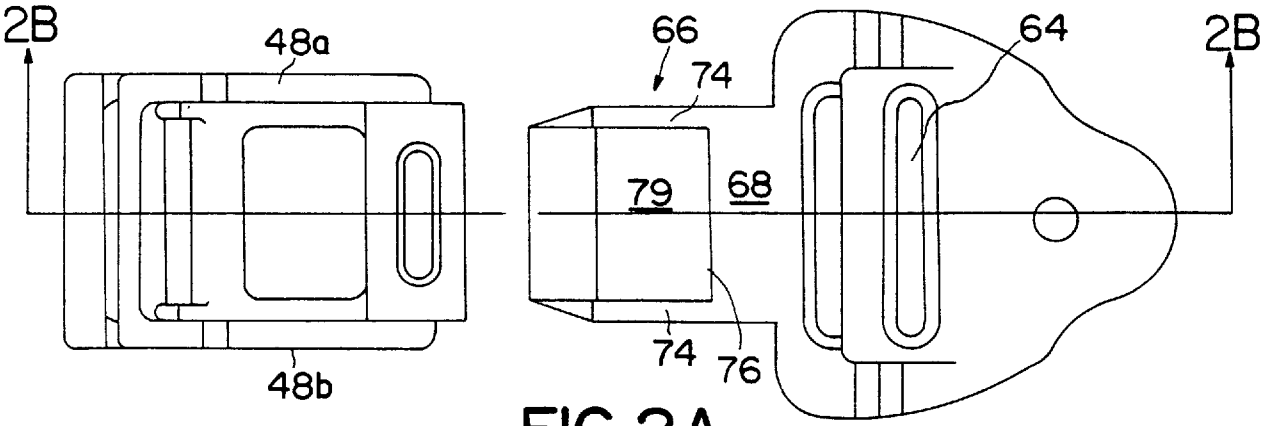
FIGS. 2*a* and 2*b*; 3*a* and 3*b*; and 4*a* and 4*b* are top and side views respectively of the buckle assembly.

Referring to FIGS. 1 and 2, a quick release buckle assembly is shown generally at 10 and comprises a keeper part 12 and a secure part 60. The keeper part 12 includes a latch 14 pivotally secured to a body 42.

Figure 2B:
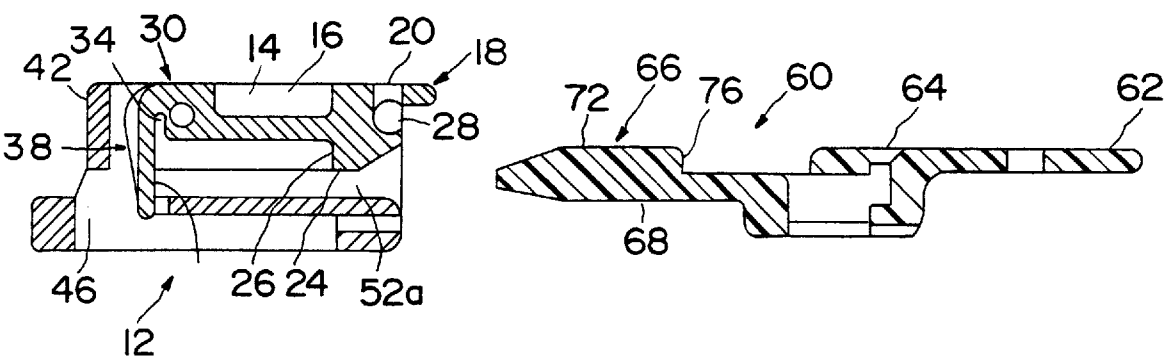

The latch 14 comprises a top 16 and has a leading edge 18. The leading edge 18 is characterized by a slot 20 through which a lanyard (not shown) is secured. Referring to FIG. 2*b*, the leading edge 18 also comprises a depending detent 24 having a flex lever capture surface 26. The detent is recessed at 28 to allow clearance for attaching a lanyard. The latch 14 further comprises a trailing edge 30 characterized by a recess 32. The trailing edge 30 has a flexible, depending tail piece 38 having a drive surface 40.

The body 42 of the keeper part 12 has a base 44 and a slot 46 formed therein through which webbing (not shown) is secured. The slot allows free movement of the tail piece 30 in the body 42. The body comprises opposed walls 48*a* and 48*b* which are mirror images of one another. The walls 48 have ribs 50*a* and 50*b* and define grooves 52*a* and 52*b* respectively.

The secure part 60 of the buckle assembly 10 comprises a rear slotted section 62 including a slot 64 for the attachment of webbing (not shown). The secure part 60 comprises a forward tongue section 66 comprising a base plate 68 and an upper chamfered tongue plate 72. The tongue plate 72 defines with the base plate 68 rails 74. The rear wall of the tongue plate 72 comprises a tongue capture surface 76.

Figure 3A:
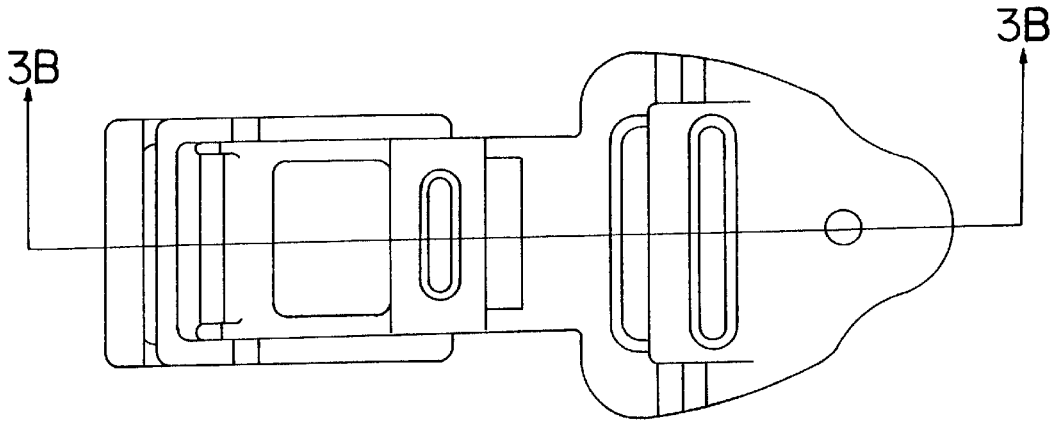
Figure 3B:
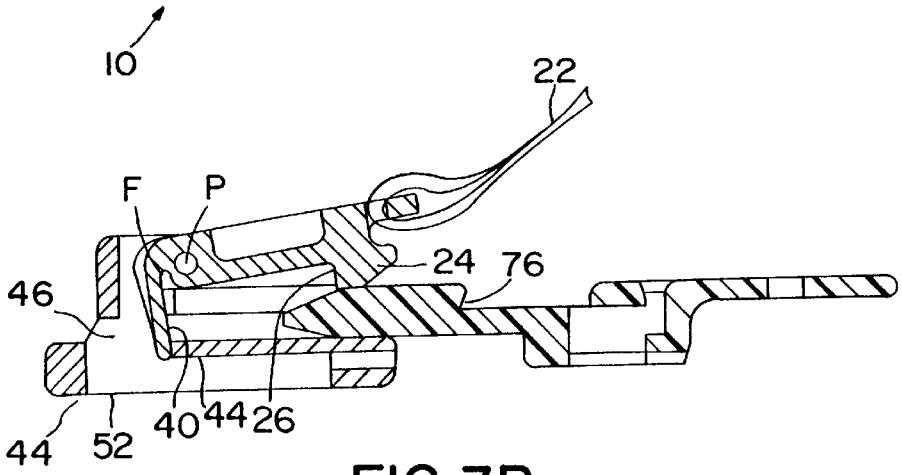
Figure 4A:
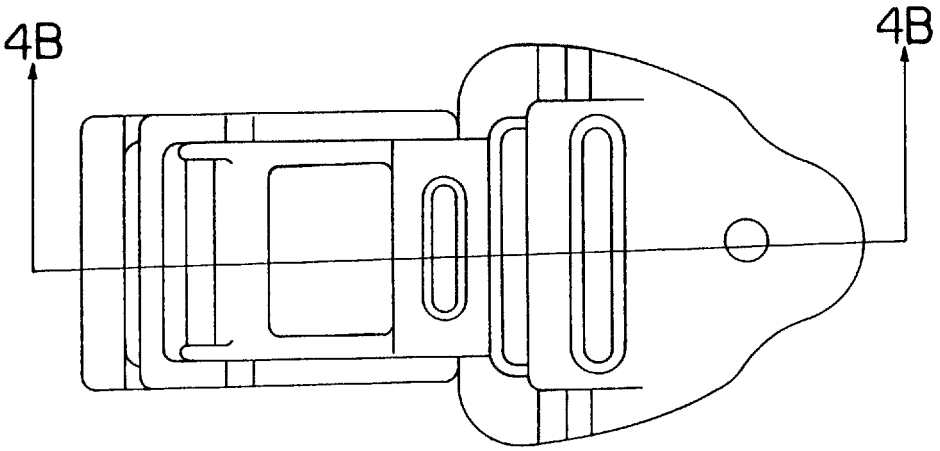
Figure 4B:
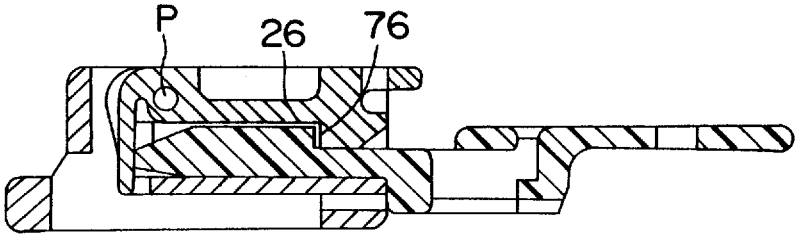

Referring to FIGS. 3 and 4, in the operation of the invention, the rails 68 of the secure part 60 slide into the grooves 52*a* and 52*b* formed in the body 42. The leading edge of the tongue section 66 engages the detent 24. As the secure part 60 continues to move into the keeper part 12, the latch 14 first rotates around the pivot shaft at point P until the surface 40 engages the base 44. This stops the rotation and prevents the rails 68 from being inserted above the grooves 52*a* and 52*b*.

Continued insertion pressure on the secure part 60 results in the leading edge of the tongue plate 72 engaging surface 40 and flexing the tailpiece 38 until the two capture surfaces 26 and 76 align, snap past each other, the flex lever capture surface 26 engages the tongue capture surface 76 and then they are positively joined in locking engagement.

In the closed position, FIG. 4, the capture surfaces 26 and 76 contact on sloped surfaces that draw them together as the buckle assembly is placed under load. Further, the leading edge of the tongue plate 72 positively engages the detent 38 of the latch 14. Whether or not placed under load, this the pre-loaded release spring feature of the flex latch keeps the buckle assembly tightly closed.

The buckle assembly is designed to prevent inadvertent or unintentional opening. To release the secure part 60 from the keeper part 12, when the release lanyard is pulled upwardly, the flex area F allows the capture surfaces 26 and 76 to disengage and release. The lanyard must be pulled along a trajectory which lies in a plane which is substantially perpendicular to the axis of rotation of the latch. The latch is free to rotate around the pivot point P and separate the secure part 60 from the keeper part 12 by driving its detent 38 against the leading end of the tongue plate 72. To ensure an unloaded fail safe release, the secure part 60 is levered by the detent 38 past the point that the capture surfaces 26 and 76 will align. It should be noted that for the capture surfaces to disengage, the flex area F must flex and thereby store energy. After the capture surfaces clear, at least a portion of the stored energy transfers to the detent 38 to drive the same. This energy or force is in addition to the release force generated by pulling the lanyard.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A quick release buckle assembly which comprises:

a keeper part comprising a body, a base formed in the body, a latch pivotally secured to the body, the body comprising a pair of opposed walls extending from the base in parallel relationship and a pair of ribs formed on the opposed surfaces of the wall which ribs define with the base a pair of grooves for guiding a mating secure part into the body, the latch having a top, the top having a leading edge characterized by a depending detent characterized by a capture surface and a trailing edge, a tail piece depending from the trailing edge, the latch being pivotally secured at its trailing edge to the opposed walls, the latch characterized by a flex area formed therein, the flex area comprises a recess formed at the juncture of the trailing edge and the tailpiece, the latch adapted for movement between two positions, a closed position which locks the secure part to the keeper part and a release position which allows for disengagement of the secure part;

a secure part having means for locating the secure part with reference to the means for guiding the secure part, the secure part having a capture surface whereby when the secure part slides into the keeper part, the latch rotates, the leading edge of the secure part engages the tail piece, the tail piece flexes, allowing the secure part to slide under the capture surface of the detent, the secure part then closes into engagement with the capture surface of the detent to lock the secure part and when the latch is moved to its open position away from the capture surface of the secure part, the tail piece drives and disengages the secure part.

2. The assembly of claim 1 wherein the secure part comprises a base plate and an upper chambered tongue plate, secured thereto to define side rails, which rails are adapted to be slideably received in the grooves of the keeper part, the tongue plate having a leading edge and a trailing edge, the capture surface of the secure part formed at the trailing edge.

3. The assembly of claim 2 wherein the capture surface of the secure part and the capture surface of the latch abut and are sloped to lock the secure part and the keeper part together under load.

4. The assembly of claim 3 wherein the leading edge is characterized by a slot whereby a lanyard can be secured to the latch.

* * * * *